US006315867B1

(12) United States Patent
Skuse et al.

(10) Patent No.: US 6,315,867 B1
(45) Date of Patent: Nov. 13, 2001

(54) DISPERSING AGENTS AND THEIR USE

(75) Inventors: David Robert Skuse, Truro (GB); Shih-Ruey Thomas Chen, Pittsburgh, PA (US); William Leonard Garforth, Sandersville, GA (US); Gary F Matz, Carnegie, PA (US)

(73) Assignee: Imerys Minerals Limited (GB)

( * ) Notice: Subject to any disclaimer, the term of this patent is extended or adjusted under 35 U.S.C. 154(b) by 0 days.

(21) Appl. No.: 08/960,789

(22) Filed: Oct. 30, 1997

(30) Foreign Application Priority Data

Nov. 2, 1996 (GB) ..... 9622905

(51) Int. Cl.[7] ..... D21H 17/67

(52) U.S. Cl. ..... 162/181.1; 162/168.1; 162/168.3; 162/181.2; 106/465; 106/499

(58) Field of Search ..... 162/135, 168.1, 162/181.1, 181.2; 106/465, 499

(56) References Cited

U.S. PATENT DOCUMENTS 4,282,059 * 8/1981 Davidson ..... 162/181.2
5,076,846 12/1991 Buri et al. ..... 106/401
5,176,797 * 1/1993 Hartan et al. ..... 162/181.1

OTHER PUBLICATIONS

WPI Abstract Acces. No. 93–285281/36 and JP52000/725A (Nichitsu) Aug. 10, 1993.
WPI Abstract Acces. No. 88–017793/03 and JP620279834A (Nippon) Dec. 4, 1987.
WPI Abstract Acces. No. 81–575490/32 and JP560073623A (Nippon) Jun. 18, 1981.

* cited by examiner

*Primary Examiner*—Peter Chin
(74) *Attorney, Agent, or Firm*—Finnegan, Henderson, Farabow, Garrett and Dunner, L.L.P.

(57) ABSTRACT

A method of dispersing a solid particulate material in an aqueous medium by addition to the aqueous medium of a dispersing agent wherein the solid particulate material is to be used as a filler or pigment in a sheet material which is required to come into contact with foodstuffs, wherein the dispersing agent is a composition comprising:

(1) up to 0.25% by weight, based on the dry weight of the particulate solid material, of a water-soluble salt of a poly(acrylic acid) having a weight average molecular weight not greater than 20,000, and (2) from 0.02% to 1.5% by weight, based on the dry weight of the particulate solid material, of either
(a) an anionic polyelectrolyte which comprises a water-soluble salt of a copolymer of acrylic acid with acrylamide; or
(b) a water-soluble condensed phosphate salt.

10 Claims, No Drawings

DISPERSING AGENTS AND THEIR USE

BACKGROUND OF THE INVENTION

This invention concerns the provision of dispersing agents and their use. In particular it concerns dispersing agents for use in processing particulate solid materials for use as fillers and pigments to be incorporated into sheet materials which are to be brought into contact with foodstuffs.

Particulate solid materials for use as fillers and pigments in sheet materials are commonly prepared for use in suspension in water or an aqueous medium. Operations which are required to render a particulate solid material suitable for these purposes include grinding to increase the particle fineness of the product, and particle size classification to select a product with the range of particle sizes which is most suitable for its desired application. These operations are often most conveniently and efficiently carried out when the particulate material is in suspension in an aqueous medium. However, if these operations are to be successfully performed, it is necessary to ensure that individual particles of the particulate material are not attracted together by electrostatic charges, to form aggregates or agglomerates of particles. For this purpose a dispersing agent is added to the aqueous medium in which the operations are performed, in order to confer a substantially uniform electric charge of the same polarity on the whole of the exposed surface of the particles. In this way the individual particles repel one another, and the formation of aggregates is substantially avoided.

A class of dispersing agents which has been found to be especially suitable for use in processing particulate solid materials in suspension in an aqueous medium is that of the anionic polyelectrolytes, and, in particular, water soluble salts of poly(acrylic acid), such as sodium or ammonium polyacrylate. These polyacrylates generally have a relatively low molecular weight; for example their weight average molecular weight is generally less than 20,000, and preferably less than 10,000.

The United States Food and Drug Administration has imposed an upper limit of 0.25% by weight, based on the weight of the dry particulate material, for the amount of a sodium polyacrylate dispersing agent to be used in the processing of a particulate material destined for use as a filler or pigment in a sheet material which will be brought into contact with certain categories of foodstuffs.

Unfortunately, such a low upper limit restricts the usefulness of polyacrylates for dispersion of materials for incorporation in food grade packaging.

Various species of water soluble chemicals are known in the prior art for use as dispersing agents. The purpose of the present invention is to provide a composition, not disclosed or suggested in the prior art, effective as a dispersing agent in the dispersion of fine particulate material for incorporation in food grade packaging.

SUMMARY OF THE INVENTION

According to the present invention there is provided a method of dispersing a solid particulate material in an aqueous medium by addition to the aqueous medium of a dispersing agent wherein the solid particulate material is to be used as a filler or pigment in a sheet material which is required to come into contact with foodstuffs, wherein the dispersing agent is a composition comprising:

(1) up to 0.25% by weight, based on the dry weight of the dry particulate solid material, of a water-soluble salt of a poly(acrylic acid) having a weight average molecular weight not greater than 20,000, and (2) from 0.02% to 1.5% by weight, based on the dry weight of the particulate solid material, of either (a) an anionic polyelectrolyte which comprises a water-soluble salt of a copolymer of acrylic acid with acrylamide; or (b) a water-soluble condensed phosphate salt.

DESCRIPTION OF THE INVENTION

The dispersing agent may be added to the aqueous medium before, during or after addition thereto of the particulate material.

The water-soluble salt of poly(acrylic acid) preferably is present in the dispersing agent composition when in use in the said method in an amount of from 0.2% to 0.25% by weight based on the dry weight of the particulate material present. The water soluble salt of poly(acrylic acid) preferably has a weight average molecular weight in the range of from 1,000 to 10,000. The cation in the water-soluble salt of poly(acrylic acid) is preferably an alkali metal, especially sodium, or ammonium.

The weight ratio of (1) to (2) in the dispersing agent composition is desirably in the range of from 1:0.1 to 1:5.

The weight ratio of (1) to (2) may be in the range 1:1 to 10:1 where (2) is a condensed phosphate salt and in the range 1:1 to 1:5 where (2) comprises a copolymer of acrylic acid with acrylamide.

The water-soluble salt of a copolymer of acrylic acid with acrylamide preferably has a weight average molecular weight not greater than 20,000, and most preferably in the range of from 1,000 to 10,000. The copolymer preferably comprises acrylic acid and acrylamide in a molar ratio of from 99.8:0.2 to 75:25, more preferably from 99.5:0.5 to 90:10.

The water-soluble condensed phosphate salt may be, for example, a hexametaphosphate, a pyrophosphate or a tripolyphosphate.

The particulate solid material will generally be an inorganic material, and may be any particulate inorganic material which is used as a filler in paper making, or as a paper coating pigment. Examples of such inorganic materials include, kaolin or china clay, whether in its natural hydroxylated state or calcined, natural or precipitated calcium carbonate, calcium sulphate, titanium dioxide, talc, mica, silica, aluminium silicate or the like.

The dispersing agent composition used in the method in accordance with the first aspect of the invention makes it possible to prepare suspensions of particulate solid materials which are at least as fluid, for a given solids concentration, as equivalent suspensions which are prepared by using the optimum amount of a water-soluble polyacrylate alone as a dispersing agent, but unexpectedly have the advantage that, if the particulate solid materials are destined for use as a filler or coating pigment for paper which comes into contact with a foodstuff, the materials meet approved regulatory standards.

The compounds specified above for use in the composition comprising the dispersing agent used in the method according to the first aspect are known per se. However, their use together in the dispersion of particulate materials for food grade products is unknown and surprisingly and beneficially allows such products to be processed and produced efficiently for that application as exemplified hereinafter.

The aqueous suspension in which the particulate solid material is dispersed in the method according to the present invention may beneficially comprise a suspension of high solids concentration, eg. wherein the solids present constitute at least 70 per cent by weight of the suspension, eg. at least 75 per cent by weight of the suspension. The suspension may comprise a composition for coating a paper or like cellulosic sheet or sheet containing material or a dispersed pigment suspension to be employed in such a composition.

Coating compositions for use in coating cellulosic sheet materials vary depending upon the materials to be coated which vary throughout the world depending upon the geography of the region in which the material is produced. As noted above, such compositions may vary from layer-to-layer in a single layer or multi-layer coated product.

The composition of each layer may include as adhesive or binder, depending on the type of composition concerned, any one or more of the hydrophilic adhesives known or used in the art, eg. selected from starches and other polysaccharides, proteinaceous adhesives, and latices.

The amount of adhesive or binder present in the composition of a given coating layer depends upon whether the composition is to be applied as a relatively dilute or concentrated pigment-containing suspension to the material to be coated. For example, a dilute pigment-containing composition (binder-rich composition) could be employed as a top-coat for underlying more pigment-rich compositions. The adhesive or binder present in the composition may range from 1% to 70% by weight relative to the dry weight of pigment (100% by weight) especially 4% to 50% by weight. Where coating composition is not to be employed as a binder rich composition the adhesive or binder may form from 4% to 30%, eg. 8% to 20%, especially 8% to 15% by weight of the solids content of the composition. The amount employed will depend upon the composition and the type of adhesive, which may itself incorporate one or more ingredients.

Additives in various well known classes may, depending upon the type of coating and material to be coated, be included in the coating composition to be concentrated by the method according to the present invention.

The particulate solid material to be dispersed in an aqueous medium in the method according to the present invention may beneficially be one comprising calcium carbonate, eg. a composition wherein at least 80% by weight of the solids present on a dry weight basis comprises calcium carbonate, eg. wherein at least 60 per cent by weight, especially wherein at least 80 per cent by weight of the particles of the calcium carbonate have an equivalent spherical diameter (as measured by the known method of sedimentation) of less than 2 $\mu$m.

Calcium carbonate may be successfully dispersed in high solids concentrations by the method according to the first aspect of the present invention to provide, surprisingly, fluid, high solids suspensions of the material.

According to the present invention in a second aspect there is provided an inorganic particulate material which has been processed using a dispersing agent wherein the dispersing agent comprises an agent as specified for use in the method according to the first aspect.

According to the present invention in a third aspect there is provided a sheet material such as a paper or paperboard product made from a composition comprising cellulosic fibres and particulate filler or coating material wherein the particulate material comprises material which is as specified in the second aspect.

Embodiments of the present invention will now be described by way of example with reference to the following Examples.

DESCRIPTION OF ILLUSTRATIVE EMBODIMENTS

EXAMPLE 1

A calcium carbonate pigment produced by grinding natural marble to give a product having a particle size distribution such that 90% by weight consisted of particles having an equivalent spherical diameter smaller than 2$\mu$m was suspended in water containing 0.25% by weight, based on the weight of dry calcium carbonate, of a conventional sodium polyacrylate dispersing agent to form a suspension containing 68.9% by weight of dry calcium carbonate.

The suspension was then divided into two portions A and B. The solids concentration of Portion A was increased to 76.1% by weight by subjecting the suspension to thermal evaporation in a laboratory rotary evaporator. The solids concentration of Portion B was also increased to 76.1% by weight, but, in this case, by spray drying part of the suspension, and mixing sufficient of the dried calcium carbonate with the undried part of the suspension to give the required solids concentration.

Each portion was then subdivided into two portions, of which one (Portions A1 and B1) was further treated with 0.1% by weight, based on the weight of dry calcium carbonate, of a sodium hexametaphosphate, and the other (Portions A2 and B2) received no further treatment.

The viscosity of each of the four suspensions was measured immediately after preparation ($T_0$), using a Brookfield Viscometer at a spindle speed of 100 rpm, and the viscosities of suspensions again after standing for 1 hour ($T_1$) and 24 hours ($T_{24}$), respectively. The results are set forth in Table 1 below.

TABLE 1

| Suspension | % solids | $T_0$ | $T_1$ | $T_{24}$ |
|---|---|---|---|---|
| A1 | 76.0 | 220 | 320 | 880 |
| A2 | 76.1 | 5800 | | |
| B1 | 76.1 | 260 | 730 | 1140 |
| B2 | 76.0 | 2250 | | |

These results show that suspensions of the natural ground calcium carbonate with a solids concentration of about 76% by weight are very viscous when prepared using 0.25% by weight, based on the weight of dry calcium carbonate, of sodium polyacrylate dispersing agent alone. However, when an additional 0.1% by weight, based on the weight of dry calcium carbonate, of sodium hexametaphosphate is added, the suspensions become much more fluid with only a moderate tendency to increase in viscosity with time. Such a suspension is useful for example in production in a known way of a paper coating composition for coating food grade cellulosic sheet products.

EXAMPLE 2

A further batch of Suspension A2, which was dispersed with the aid of 0.25% by weight, based on the weight of dry calcium carbonate, of sodium polyacrylate dispersing agent alone, was treated with an additional quantity of 0.75% by weight, based on the weight of dry calcium carbonate, of a copolymer formed by copolymerising acrylic acid and acrylamide in the molar ratio 99.5:0.5. The viscosity of the suspension (A3) was measured immediately after preparation ($T_0$), and after standing for 1 hour and 24 hours ($T_1$ and $T_{24}$, respectively). The results are shown in Table 2 below, with the result for Suspension A2 from Table 1 for comparison.

TABLE 2

| Suspension | % solids | $T_0$ | $T_1$ | $T_{24}$ |
|---|---|---|---|---|
| A2 | 76.1 | 5800 | | |
| A3 | 76.0 | 275 | 320 | 420 |

These results show that the suspension prepared with the use of the additional dose of the copolymeric dispersing agent has a low initial viscosity, and only a small tendency to increase in viscosity with time. Such a suspension is useful for example in the production in a known way of a paper coating composition for coating food grade cellulosic sheet products.

What is claimed is:

1. A method of dispersing a solid particulate material in an aqueous medium by addition to the aqueous medium of a dispersing agent wherein the solid particulate material is to be used as a filler or pigment in a sheet material which is required to come into contact with foodstuffs, wherein the dispersing agent is a composition comprising:

(1) up to 0.25% by weight, based on the dry weight of the solid particulate material, of a water soluble salt of a poly(acrylic acid) having a weight average molecular weight not greater than 20,000; and (2) from 0.02% to 1.5% by weight, based on the dry weight of the solid particulate material, of an anionic polyelectrolyte which is a water soluble salt of a copolymer of acrylic acid and acrylamide having a weight average molecular weight of from 1,000 to 10,000 and a molar ratio of acrylic acid to acrylamide in the range of from 98.8:0.2 to 90:10;

wherein the weight ratio of (1) to (2) present in the composition is from 1:1 to 1:5.

2. A method as claimed in claim 1 and wherein the water-soluble salt of poly(acrylic acid) has a weight average molecular weight in the range 1,000 to 10,000 and is an alkali metal or ammonium salt.

3. A method as claimed in claim 1 and wherein the water soluble salt of poly(acrylic acid) is present in the dispersing aspect composition in an amount of from 0.2% to 0.25% by weight based on the dry weight of the particulate material present.

4. A method as claimed in claim 1 and wherein the weight ratio of (1) to (2) is in the range of from 1:0.1 to 1:5.

5. A method of dispersing a solid particulate material in an aqueous medium by addition to the aqueous medium of a dispersing agent wherein the solid particulate material is to be used as a filler or pigment in a sheet material which is required to come into contact with foodstuffs, wherein the dispersing agent comprises from 0.02% to 1.5% by weight, based on the dry weight of the solid particulate material, of an anionic polyelectrolyte, which is a water soluble salt of a copolymer of acrylic acid and acrylamide having a weight average molecular weight of from 1,000 to 10,000, and a molar ratio of acrylic acid to acrylamide in the range of from 98.8:0.2 to 90:10.

6. A method according to claim 5, wherein the water-soluble salt of a copolymer of acrylic acid and acrylamide has a molar ratio of acrylic acid to acrylamide in the range of from 98.8:0.2 to 75:25.

7. A method as claimed in claim 5 and wherein the particulate material is selected from kaolin or china clay, calcined kaolin or calcined china clay, natural or precipitated calcium carbonate, calcium sulphate, titanium dioxide, talc, mica, silica and aluminium silicate.

8. An inorganic particulate material which is produced by the method claimed in claim 7 and which is suitable for use as a filler or coating pigment for paper or paperboard products.

9. A paper or paperboard product made from a composition comprising fibre and a particulate filler or coating material comprising inorganic particulate material as claimed in claim 8.

10. A paper or paperboard product as claimed in claim 9 and which is suitable for use in a food grade product.

* * * * *